United States Patent [19]

Regan

[11] 4,406,450

[45] Sep. 27, 1983

[54] MINI PARALLEL BARS

[76] Inventor: Kent R. Regan, 1738 Oak St., Lake Oswego, Oreg. 97034

[21] Appl. No.: 382,896

[22] Filed: May 28, 1982

[51] Int. Cl.[3] ..... A63B 3/00

[52] U.S. Cl. ..... 272/63

[58] Field of Search ..... 272/62, 63, 93, DIG. 4, 272/109, 67, 144; 52/648, 654, 655

[56] References Cited

U.S. PATENT DOCUMENTS

| | | | |
|---|---|---|---|
| 1,410,149 | 3/1922 | Williams et al. | 272/62 |
| 3,083,964 | 4/1963 | Wentzel | 272/60 |
| 3,184,232 | 5/1961 | Nissen | 272/63 |
| 3,258,790 | 7/1966 | Maru | 272/62 |
| 3,562,994 | 2/1971 | Linsowe | 52/655 |
| 4,046,373 | 9/1977 | Kim | 272/63 |
| 4,222,559 | 9/1980 | Hammer | 272/63 |

OTHER PUBLICATIONS

NASA Tech Briefs, Removable Fastener for Large Structures, vol. 4, No. 1, Spring 1979, p. 126.

*Primary Examiner*—Richard C. Pinkham
*Assistant Examiner*—Stephen R. Crow
*Attorney, Agent, or Firm*—Henderson & Sturm

[57] ABSTRACT

This invention relates to gymnastic exercise devices in general and more specifically to a pair of individual bar members formed on separate support elements to produce a variable spacing quasi-parallel bar structure, which is particularly well suited for the beginning, or younger gymnast.

6 Claims, 4 Drawing Figures

FIG. 1.
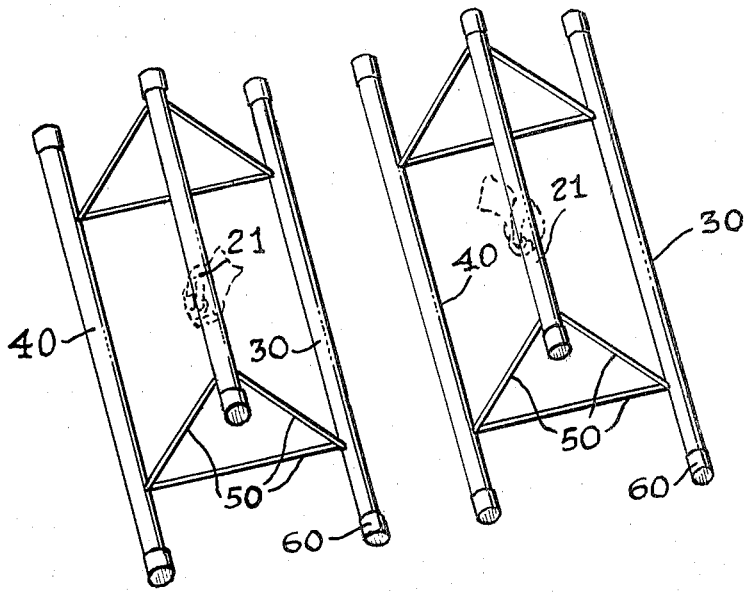
FIG. 2.
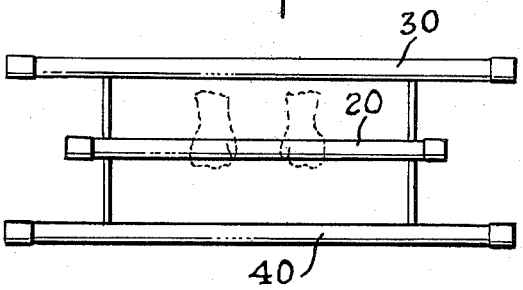
FIG. 3.
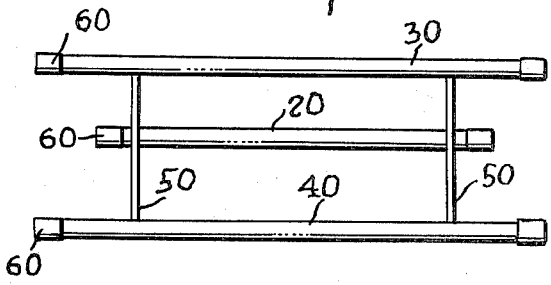
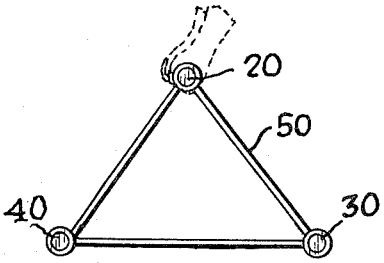
FIG. 4.

MINI PARALLEL BARS

BACKGROUND OF THE INVENTION

While the prior art is replete with gymnastic exercise devices, such as can be seen by reference to U.S. Pat. Nos. 3,184,232; 4,046,373; 4,222,559 and 3,083,964, none of these devices solves the problems encountered by beginning or younger gymnast in finding equipment, which is specifically designed to accommodate either their lack of size, or experience.

Even though adjustable height and width parallel bar devices have been developed in the past, these structures have shared the following deficiencies; they have been too heavy and/or bulky for the gymnast to easily transport between the gymnasium and have been unduly mechanically complex in their height and width adjustment mechanisms, so that when the parallel bars are properly adjusted for one person, they will normally require readjustment before another gymnast can utilize them.

The above mentioned problems are further compounded when a large group of gymnast will be using the equipment in rapid succession, such as in gymnastic class. Additional problems are experienced by young and/or inexperienced gymnast; in that their shoulder spans are quite a bit narrower than the spacing found on most parallel bar structures; and the inexperienced gymnast, knowing that the likehood of repeated falls from the bars are to be expected until some degree of competence is achieved, are reluctant to practice on bars that are set too far above floor level.

In order to solve the aforementioned problems, an entirely new concept in parallel bar structures would have to be developed. A result of that rethinking process is found in the present invention, which comprises a compact pair of individual bar members having a wide base for stability and a low profile with respect to the floor. In addition the hand rails are recessed from the ends of the base member, so that even forces applied to the very ends of hand rails will not cause the device to tip over. The final advantage of this invention is that due to its compact size, lightweight but sturdy construction and the fact that there are two separate members, transportation of the device between home and gymnasium became a simple task.

SUMMARY OF THE INVENTION

An object of this invention is to provide a safe, stable, portable gymnastic exercising device, which is particularly well suited for beginning and younger gymnast.

Another object of the present invention is the provision of two independent structures, which are intended for use with one another, to form a quasi-parallel bar structure.

Still another object of the present invention is the provision of a compact gymnastic exercise device, which due to the fact that it comprises two identical members, is easily transported between the gymnasium and home, for use in either location.

Yet another object of the present invention is the provision of low profile parallel bar device, which due to its closeness to the ground, will overcome a young gymnasts fear of falling from any distance, while not in complete control of their bodies, and will also prevent injuries from that type of a fall.

A further object of this invention is the provision of a parallel bar structure, which will instill confidence and enable a gymastic student to become familiar with, and adept at, the various exercises performed on the standard size units.

A still further object of the present invention is the provision of an extremely stable support surface for the individual bar elements, that will not allow the support surface to tip over, even if the gymnast is applying his or her weight on the very ends of the bar surface.

These and other objects advantages and novel features of the invention will become apparent from the detailed description which follows, when considered in conjunction with the accompanying drawings.

BRIEF DESCRIPTION OF THE DRAWINGS

FIG. 1 is a perspective view of the two identical elements, which comprise the invention.

FIG. 2 is a top plan view of one the elements of the invention.

FIG. 3 is a bottom plan view of one of the elements of the invention.

FIG. 4 is a end view of one of the elements of the invention.

DETAILED DESCRIPTION OF THE PREFERRED EMBODIMENT

As can be seen by references to FIG. 1, this invention comprises a set of two identical individual bar members, designated generally as 10. Since one bar member is exactly the same as the other, only one of them will be described in detailed in the specification.

Each individual bar member 10 comprises three tubular elements 20, 30 and 40, which are joined together by a plurality of rod elements 50, in a generally elongated equilateral triangular configuration.

All of the tubular elements 20, 30 and 40 may be fabricated from the same tubular stock for the purpose of uniformity and aesthetic considerations; however, tubular element 20 is substantially shorter in length than the other tubular members, for reasons that will become readily apparent.

Tubular elements 30 and 40 have the same length, and form the base of the bar member 10, while tubular element 20 forms the hand rail or bar element 21 for each bar member, and has a length significantly less than the other tubular elements. Each of the connecting rods 50 may likewise be fabricated from the same solid rod; however, in the preferred embodiment each of the rods 50 have the same length.

In order to form the equilateral triangular configuration depicted in FIG. 4, each tubular element is provided with a pair of rod elements 50 proximate its respective ends, which are connected to the other tubular elements proximate their respective ends.

In the preferred embodiment illustrated in FIGS. 1 thru 4 the tubular members were formed from $1\frac{5}{8}''$ tubular stock and the base members were 24" in length, while the bar element was 20" in length. The six rod elements 50 were formed from a $\frac{1}{2}''$ diameter metal rod, and each of the rods was 10" in length.

The rods are permanently attached to the tubular elements in any suitable manner such as welding, "super" adhesives, etc. Since each of the rod elements are the same length, they will connect the tubular elements together in the form of an elongated equilateral triangle, as shown in FIG. 4.

As an added safety factor, the ends of all of the tubular elements are provided with soft rubber or plastic caps 60. These protective caps not only cover the sharp ends of the cut tubing, but in the case of the bar element 21, provides a sensory warning surface for the gymnast, to inform them that they are gripping the extreme end of the bar element, and that the grip should be shifted towards the midpoint.

As can best be seen in FIGS. 2 and 3, the connecting rods 50 are secured adjacent to the ends of the tubular element 20, which forms the bar element 21, yet the rods 50 are secured proximate to, but spaced from, the ends of the tubular elements 30 and 40, which form the base of the bar member 10.

This particular construction insures that the ends of the tubular elements forming the base, project at least twice the distance that the shorter tubular element 20 projects beyond the point that the six rods connect all of the tubular elements together. Therfore when the weight of a gymnast is exerted on the extreme end of the bar element 21, the excess length of the tubular elements forming the base will counterbalance this over-center force to prevent the bar member from tipping over.

Given the fact that two bar members 10 are required to practice this invention, it should be readily apparent that the individual members may be spaced apart to accommodate shoulder spans, ranging from a very small child, to a very large adult.

The triangular configuration of the three support rods on each of the bar member, not only creates a tremendous amount of stability for the bar element 21, but also limits the vertical height of the bar member to a value approximately equal to the length of the support rods.

Since it is desirable to keep the profile of the bar members as low to the ground as possible for the reasons enumerated supra, the length of the supporting rods should never exceed 18" and the combined height of the tubular elements and connecting rods should never exceed 24".

Having thereby described the subject matter of this invention, it should be obvious that many substitutions, modifications and variations of the invention are possible in light of the above teachings. It is therefore to be understood that the invention as taught and described is only to be limited by the breadth and scope of the appended claims.

What I claim is:

1. A gymnastic practice and exercise apparatus comprising:

a pair of individual bar members which when used together form a low profile, variable width parallel bar exercise device; wherein, each individual bar member comprises:

two parallel elongated tubular base members connected to one another by at least a pair of connecting rods, and a tubular hand rail element having a length substantially less than the length of said base member, and connected to each of said base members by at least a pair of connecting rods, wherein, all of the said connecting rods have the same length, and join the base members and the hand rail element into the form of an elongated triangle.

2. The apparatus as in claim 1; wherein, at least some of the said connecting rods are joined to the hand rail element proximate its respective ends.

3. The apparatus as in claim 2; wherein, at least some of the said connecting rods are attached adjacent to, but spaced from, the ends of said base members.

4. The apparatus as in claim 1; wherein, the maximum length of the connecting rods is 18 inches.

5. The apparatus as in claim 1; wherein, the maximum height of each bar member is 24 inches.

6. The apparatus as in claim 1; wherein, the maximum length of each bar member is 24 inches.

* * * * *